United States Patent [19]

Fratangelo et al.

[11] Patent Number: 5,020,805

[45] Date of Patent: Jun. 4, 1991

[54] WAR GAME

[76] Inventors: John J. Fratangelo, 266 Ridge Rd., New City, N.Y. 10956; George Spector, 233 Broadway, New York City, N.Y. 10007

[21] Appl. No.: 446,683

[22] Filed: Dec. 6, 1989

[51] Int. Cl.[5] ..... A63F 3/00

[52] U.S. Cl. ..... 273/255; 273/262

[58] Field of Search ..... 273/242, 243, 249, 255, 273/262

[56] References Cited

U.S. PATENT DOCUMENTS

| | | | |
|---|---|---|---|
| 1,221,244 | 4/1917 | Swartwood | 273/255 X |
| 2,799,504 | 7/1957 | Keyko | 273/262 |
| 2,964,323 | 12/1960 | Moses | 273/255 |
| 3,155,391 | 11/1964 | Chittenden | 273/262 X |
| 3,455,556 | 7/1969 | Mossman | 273/262 X |
| 4,114,891 | 9/1978 | Lawrimore | 273/255 X |
| 4,415,160 | 11/1983 | Lamb | 273/255 X |

*Primary Examiner*—Edward M. Coven
*Assistant Examiner*—William E. Stoll

[57] ABSTRACT

A Vietnam war board game is provided and consists of a game board having a plurality of different trails in which each player using one of the trails trys to reach a prisoner of war camp, deep in a jungle, with a minimum of three of their five man squad to free prisoners.

4 Claims, 8 Drawing Sheets

38a to 38d 52a to 52d

WAR GAME

BACKGROUND OF THE INVENTION

The instant invention relates generally to board games and more specifically it relates to a long range reconnaissance patrol Vietnam war board game which provides a five men long range reconnaissance patrol on a combat mission to free prisoners of war.

There are available various conventional board games which do not provide the novel improvements of the invention herein disclosed.

SUMMARY OF THE INVENTION

A primary object of the present invention is to provide a long range reconnaissance patrol Vietnam war board game that will overcome the shortcomings of the prior art devices.

Another object is to provide a long range reconnaissance patrol Vietnam war board game in which the objective of the game is to reach a prisoner of war camp, deep in a jungle, with a minimum of three of your five men to free prisoners.

An additional object is to provide a long range reconnaissance patrol Vietnam war board game that is devised to familiarize players with wartime hazards, so the players can realize just how important it is to maintain peace, so as to keep war, as a table top game for all to enjoy.

A further object is to provide a long range reconnaissance patrol Vietnam war board game that is simple and easy to use.

A still further object is to provide a long range reconnaissance patrol Vietnam war board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIGS. 1*a* to 1*d* are a top plan view of the game board of the invention.

DETAILED DESCRIPTION OF THE PREFERRED EMBODIMENTS

Figure 1A:
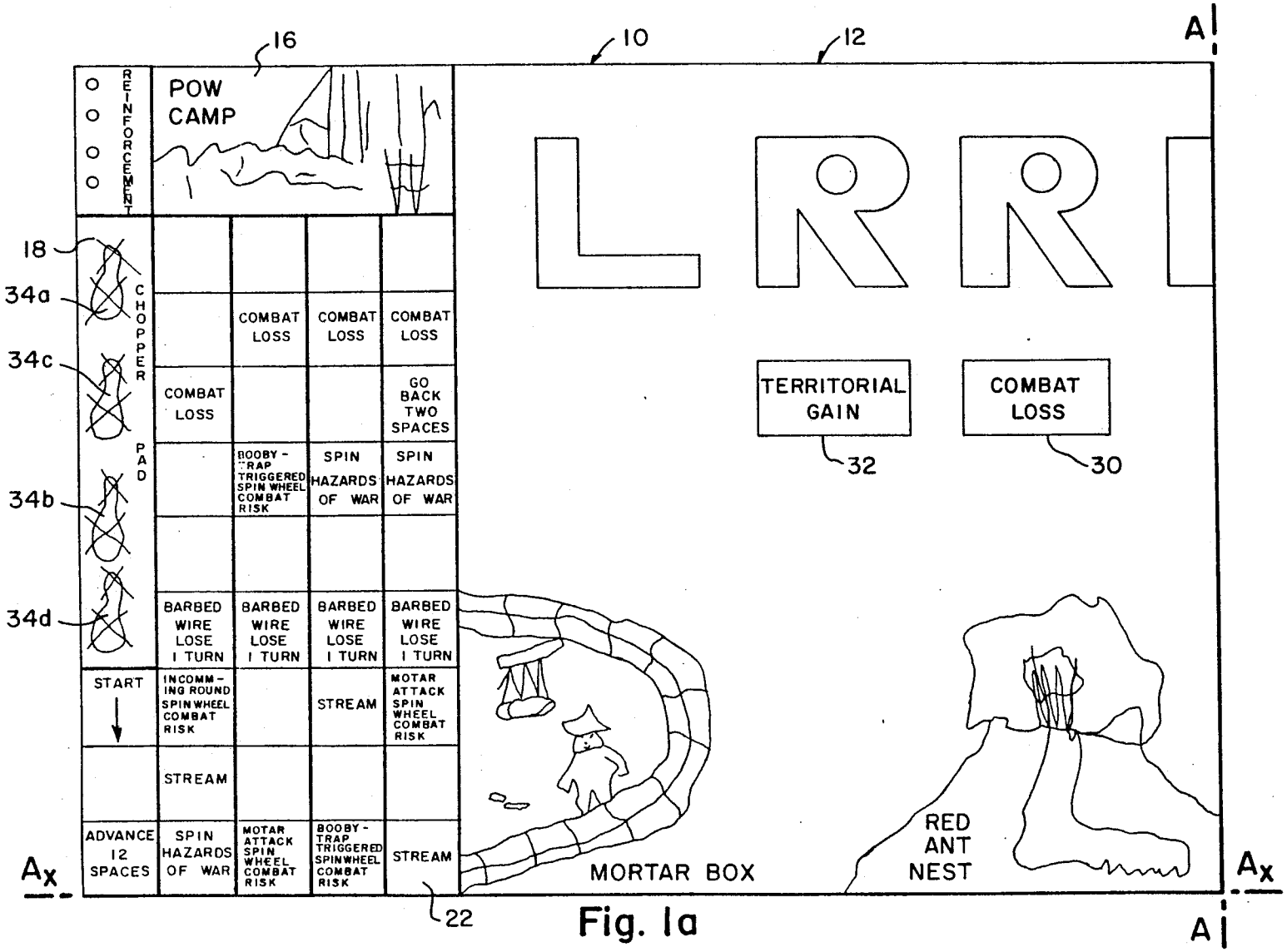
Figure 1A:
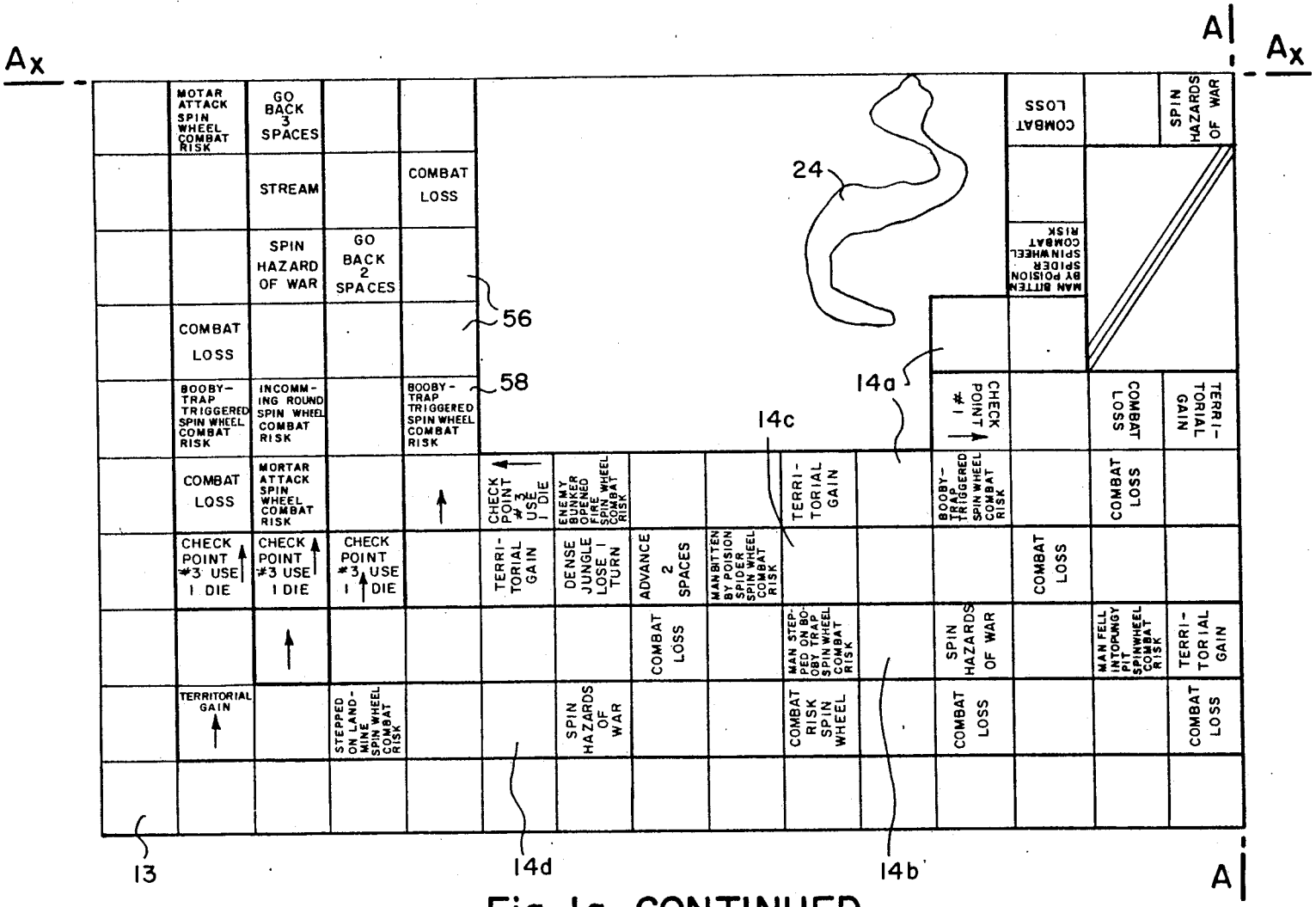
Figure 1B:
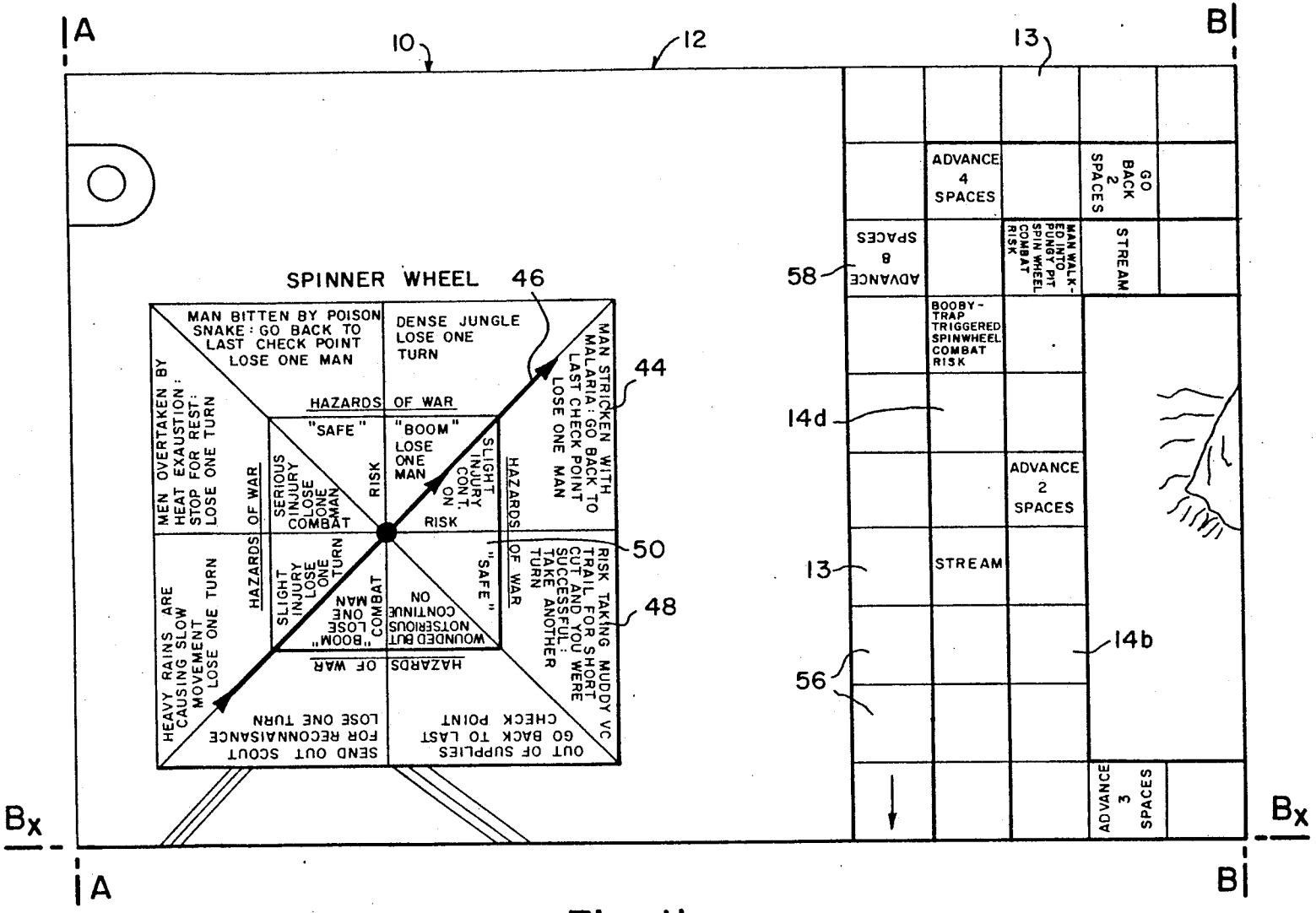
Figure 1B:
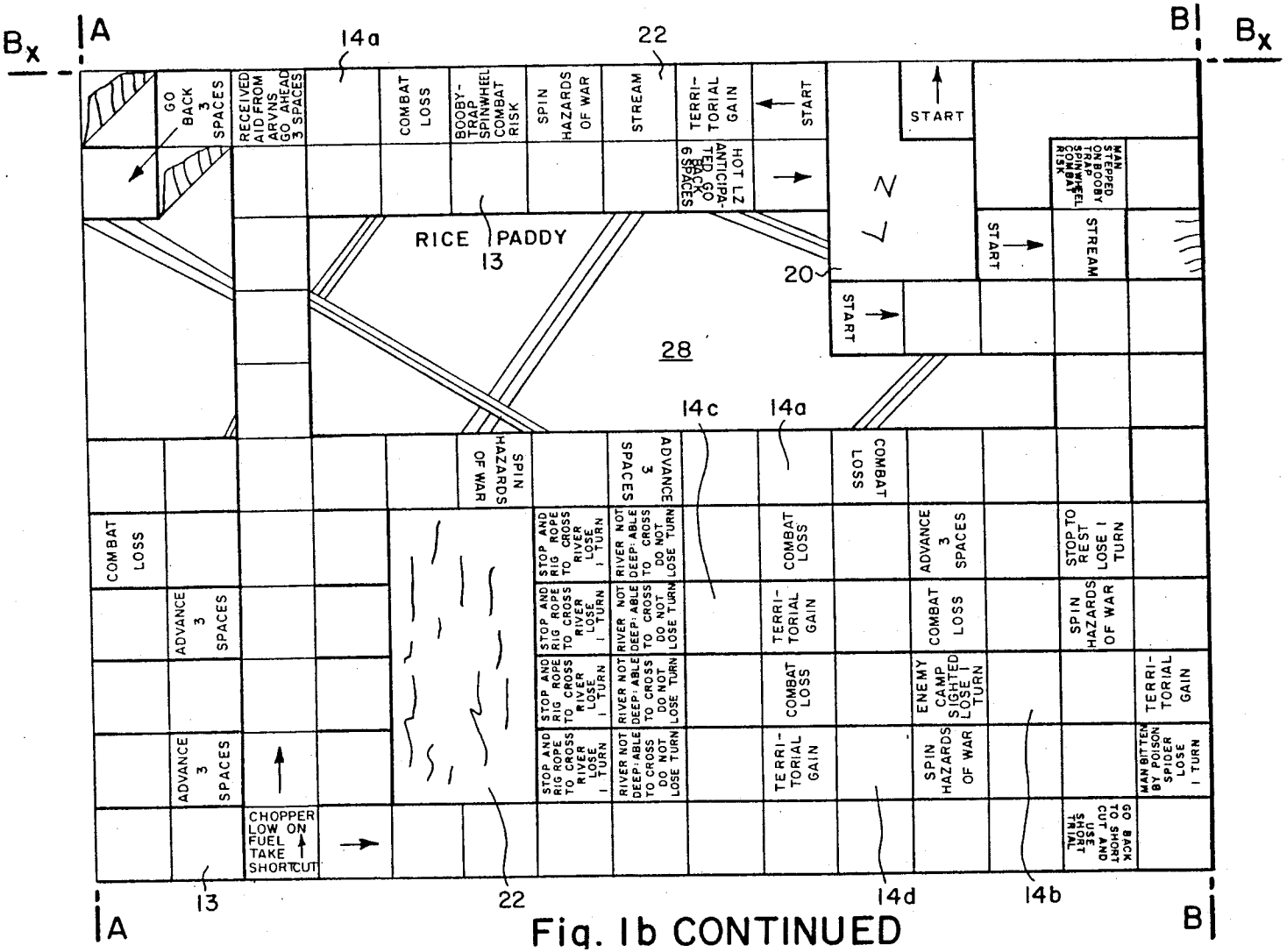
Figure 1C:
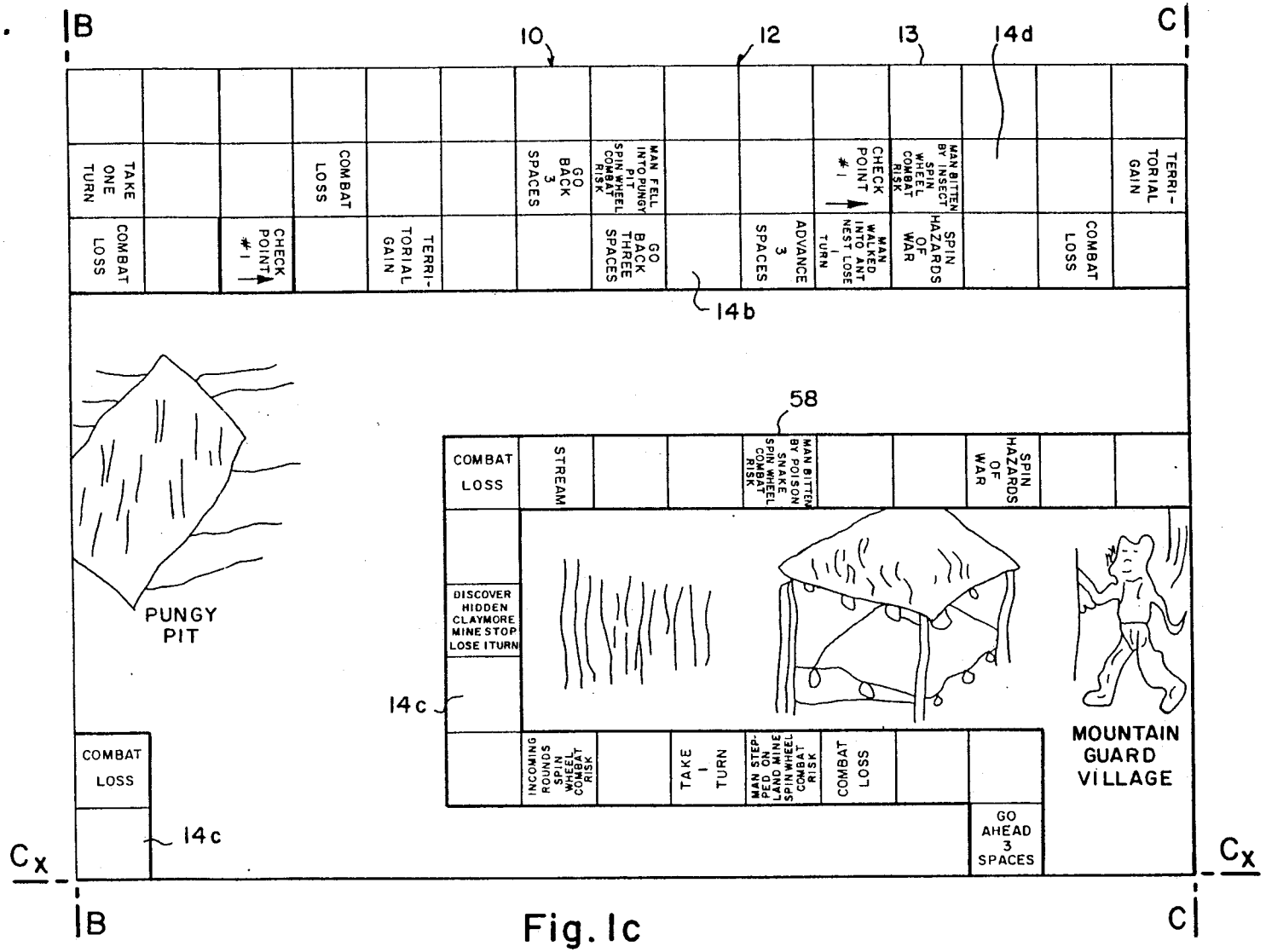
Figure 1C:
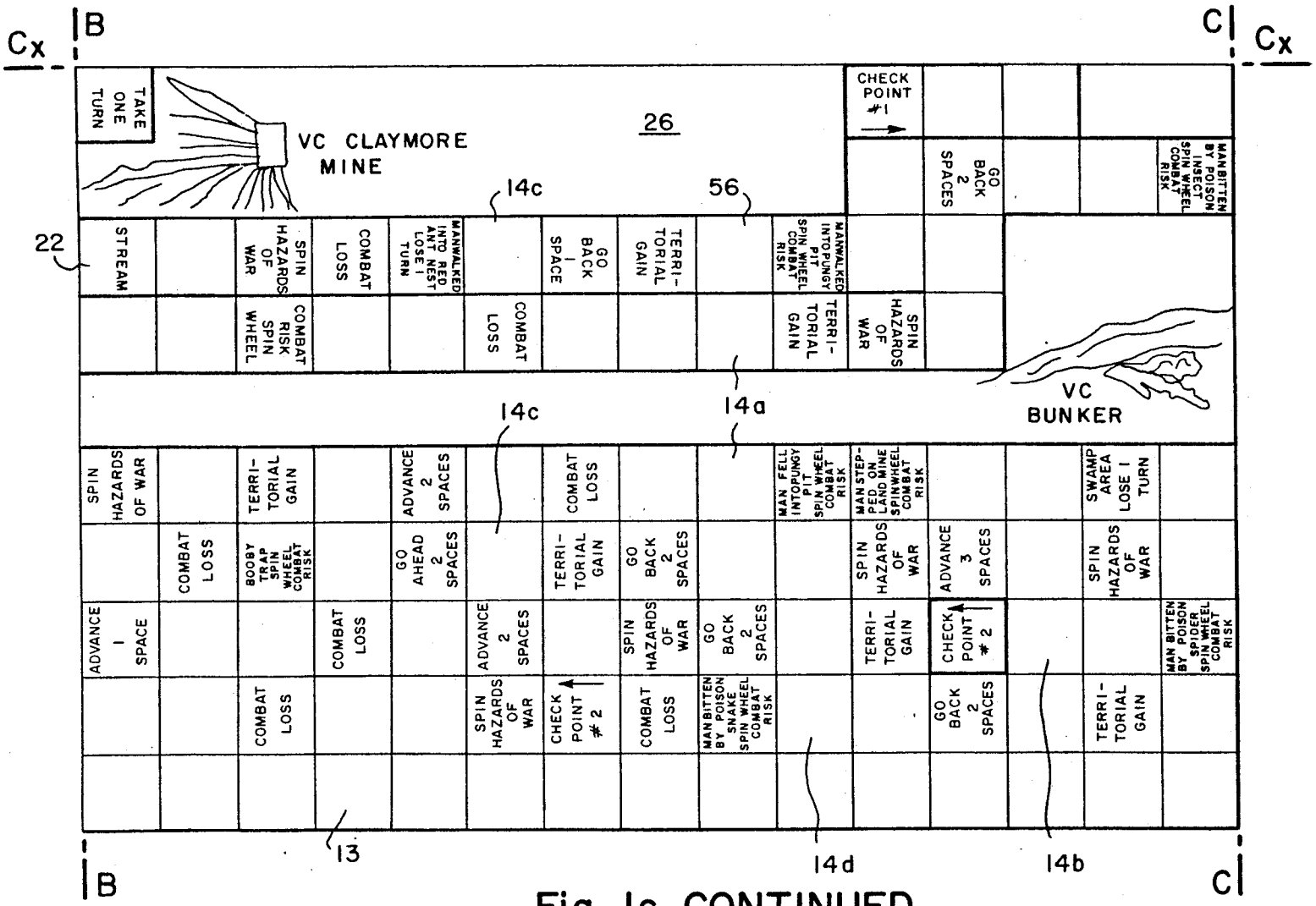
Figure 1D:
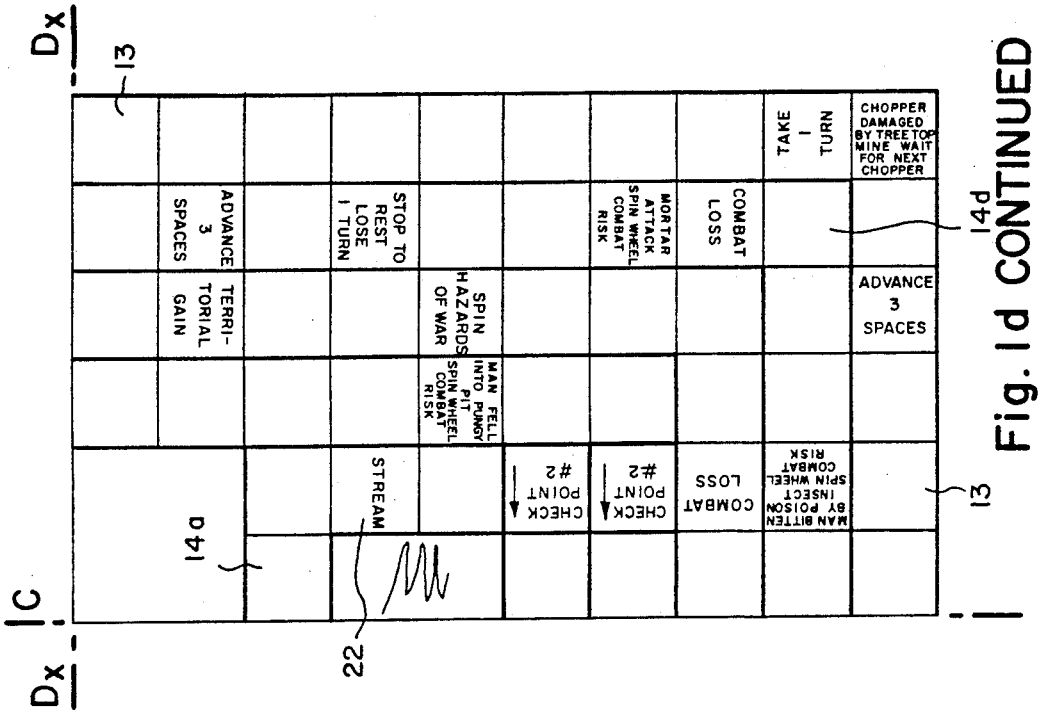
Figure 1D:
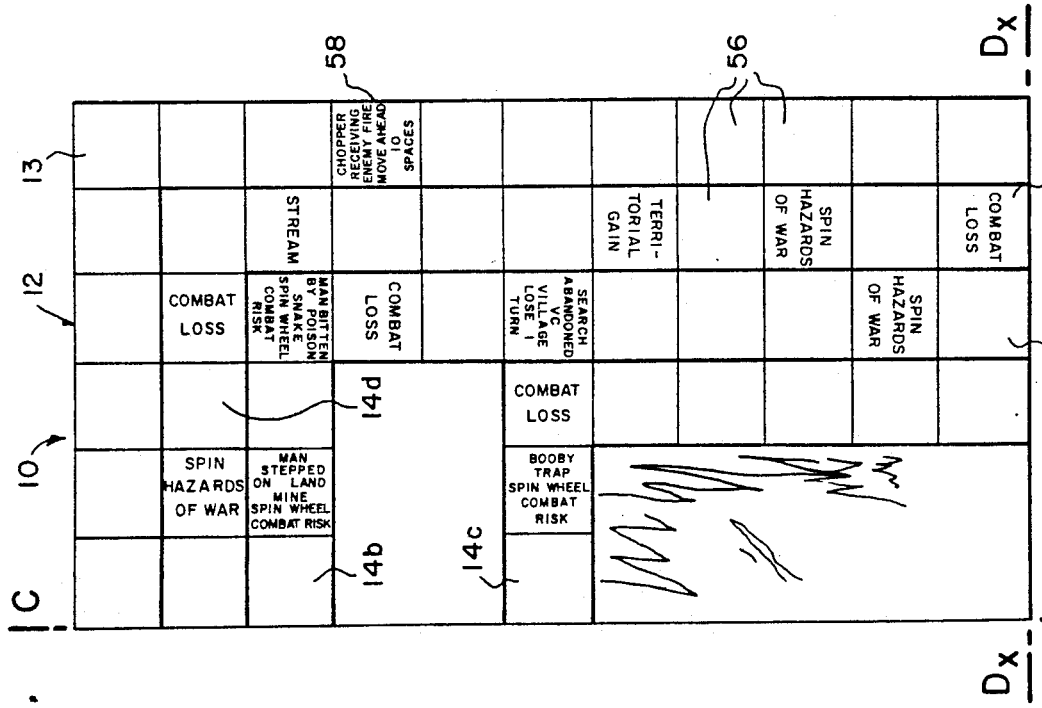
Figure 2:
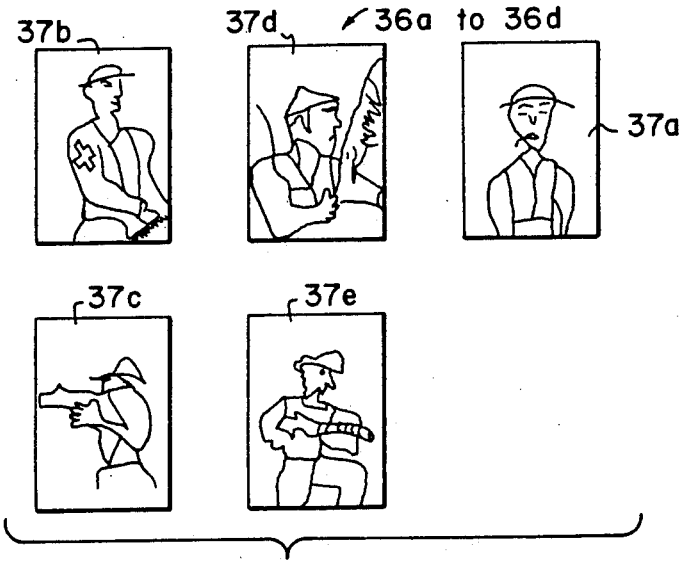
FIG. 2 is a top plan view of the character cards of the five man squad.
Figure 3:
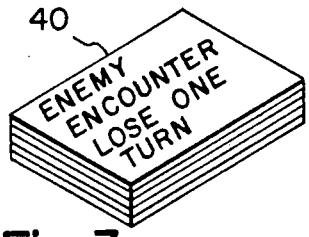
FIG. 3 is a perspective view of the combat loss cards.
Figure 4:
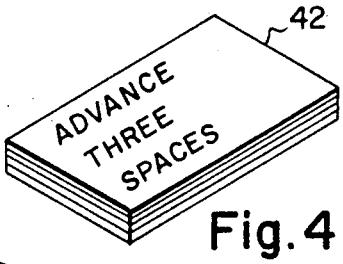
FIG. 4 is a perspective view of the territorial gain cards.

Turning now descriptively to the drawings, in which similar reference characters denote similar elements throughout the several views, the Figures illustrate a long range reconnaissance patrol Vietnam war board game 10, consisting of a game board 12 with jungle background having five different colored trails, such as a blue trail 13, for a chopper ride and four other trails being brown 14*a*, yellow 14*b*, green 14*c* and orange 14*d*, to be used by squads on foot. The game board 12 also has a POW camp 16, chopper pad 18, L.Z. 20, river and streams 22, V.C. trails 24, V.C. village 26, rice paddy 28, combat loss space 30 and territorial gain space 32 disposed onto background of the game board 12.

Four helicopter playing pieces 34*a* to 34*d* are each colored to match one of the colored foot trails 14*a* to 14*d*. Four sets of squad teams 36*a* to 36*d* of five squad member character cards 37*a* to 37*c* are provided. Each squad team set is colored to match one of the helicopter playing pieces 34*a* to 34*d*. Four first type pawns 38*a* to 38*d* represent squad movement on the game board 12. Each pawn is colored to match one of the squad teams 36*a* to 36*d* of squad member character cards. Twenty combat loss cards 40 and twenty territorial gain cards 42 are also provided.

A spinner wheel 44 has a double headed pointer 46 to randomly point to a combination of hazards of war 48 and combat risk 50 information to be used during play of the board game 10. Four second type pawns 52*a* to 52*d* represent reinforcements. Each pawn is colored to match one of the squad teams 34*a* to 34*d* of squad member character cards, while a pair of playing dice 54 are also provided.

Each squad member character card of each squad team set 34*a* to 34*d* includes a squad leader card 37*a* being head man and decision maker of the squad team, a medic card 37*b* being a man with medical knowledge of first aid treatment, a rifleman card 37*c* being a man using an M-16 automatic, semi-automatic weapon, a M-79 man card 37*d* being a man carrying a weapon used to launch grenade type projectiles and also carries the squad radio and a machine gunner card 37*e* being a man carrying an M-60 automatic machine gun.

Each trail 13, 14*a* to 14*d* on the game board 12 includes a plurality of playing segments 56 having indicia 58 on some of the playing segments to indicate playing instructions during play of the board game 10.

Figure 8:
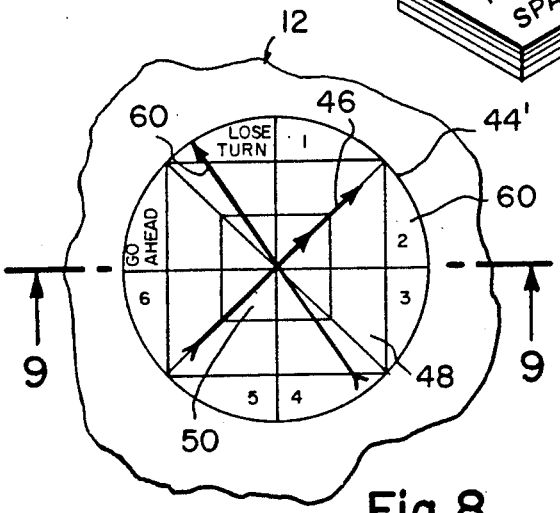
FIG. 8 is a top plan view of a portion of the game board showing a modified spinner wheel in which a second pointer is used instead of the dice.
Figure 5:
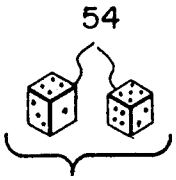
FIG. 5 is a perspective view of the playing dice.
Figure 6:
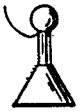
FIG. 6 is an elevational view of one of the squad pawns.
Figure 7:
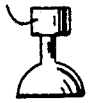
FIG. 7 is an elevational view of one of the reinforcement pawns.
Figure 9:
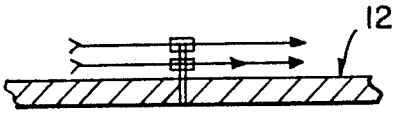
FIG. 9 is a cross sectional view taken along line 9—9 in FIG. 8 showing the structure therein.

As shown in FIGS. 8 and 9, the spinner wheel 44' is modified to include a second single headed pointer 60 and a plurality of numbers such as 1 to 6 plus "go again" and "lose turn" disposed thereabout. The two pointers 46 and 60 can be used together, to randomly choose numbers to move the helicopter playing pieces 34*a* to 34*d*, the first type pawns 38*a* to 38*d* and the second type pawns a to d along the playing segments 56 of the trails 13, 14*a* to 14*d* in place of the playing dice 54.

TERM AND EXPRESSIONS USED IN THE GAME

1. KIA—Killed in Action
2. WIA—Wounded in Action
3. MEDI-VAC —Medical Evacuation
4. CHOPPER—Helicopter
5. LZ—Landing Zone
6. FIRE FIGHT—Battle Against the Enemy 7. MORTAR ATTACH—Highly Effective Explosive Missiles Launched From a Distant Location 8. CLAYMORE MINE—Very Powerful Hand Detonated Bomb 9. PUNGY PIT—A booby trap consisting of a hole dug in the ground, containing upright pointed bamboo spears that have been dipped in poison 10. CHECK POINT—Designated Area For Regrouping 11. BOOBY TRAP—Trap set off by triggering a string or wire attached to an explosive mechanism, or a series of pointed objects designed to kill or maim. Also a hole in the ground filled with poisonous snakes or insects or pointed objects, that has been covered with camouflage 12. LANDMINE—Explosive triggered off by stepping on 13. AMBUSH—Enemy waiting and ready for squad to walk right into their trap. Usually the enemy is dug in secure and heavily armed 14. V.C.—Viet Cong (enemy)

15. ARVNS—Regular Army Of South Viet Nam

16. MOUNTAINGNARD VILLAGERS—Primative-like natives of Viet Nam

17. INCOMING ROUNDS—Receiving enemy fire

18. AIR STRIKE—Call for air force bombers to fire rockets on a designated area

19. SNIPER—Enemy sharpshooter well hidden

20. MACHINE GUN NEST—Position containing a machine gun,

OR BUNKER usually well dug in and hard to defeat

21. SMOKE GRENADE—Similar to a grenade with a pull-pin to emit different colored smoke to mark a location for choppers to land or air strike White Smoke used for marking enemy location for an air strike Yellow Smoke used for a chopper landing zone or man location 22. PUFF—Special chopper equipped with miniguns (extremely rapid firing machine guns), used for air support when enemy position is located

RULES

The game can be played with 1–4 players ages 8 to adult.

The objective of the game is to reach the prisoner of war clamp, deep in the jungle, with a minimum of 3 of your 5 men, to free the prisoners.

1. Players shoot dice to determine rotation of play.

2. Each player selects the color of his helicopter, squad, and trail to be used.

3. When each player knows their respective colors, they place their squad in front of them, face up. The squad consists of 5 men.

a. Squad leader b. Medic c. M-79 man carrying radio d. M-16 man e. Machine gunner carrying M-60 machine gun 4. The players then remove their chopper (helicopter) from the chopper pad and place them on the blue chopper trail marked START. These helicopters carry the squads to the L.Z.

5. The dice are thrown for number of spaces to be taken. Doubles thrown on the dice constitute another turn. There is no limit to the amount of doubles thrown on chopper trail; however, there is a limit of 3 doubles thrown on the jungle trails, When a player throws 3 doubles while on foot in the jungle, he plays out his moves and relinquishes the dice over to the next player.

6. If a player lands on the space marked ("Chopper low on fuel, take short cut"), he then proceeds along the shorter blue trail, indicated by a direction arrow. If a player does not land on the short-cut space, he continues on the chopper trail. If he lands on ("Chopper damaged by tree top claymore mine, wait for next chopper"), he must remain where he is and start his chopper at the beginning and wait for it to meet up to the squad at that space. This chopper must by-pass the space marked "short cut" and continue on to pick up the waiting men. Once the chopper meets the squad, they continue on regardless if the chopper lands on the ("Damaged Space") or not.

7. Once the players reach the L.Z. (Landing Zone) or (Drop off Point), they start on their way on their respective trails, by shooting dice.

8. Players simply follow board directions and instructions of "Combat Loss" and "Territorial Gain" cards throughout the game.

9. Each trail has three check points along the way. These check points are for retuning to wait for reinforcements, or to evacuate a wounded man or a man killed in action (WIA or KIA).

10. If a man is lost in action, the player then turns the card representing that man, face down. If a player has a choice of which man to lose, he then turns the card representing the man of his choice, face down. If a man is to be eliminated by board or card instruction, and that particular man has already been removed then the player does not have to lose another man from his squad. (This is where strategy of choice of loss of man comes into play).

11. A player must have a minimum of three men to reach the objective (Prisoner of War Camp). If the player has less than three men, he must automatically return to his last check point and wait for reinforcements. He may do so at any point in the game of his choice prior to reaching the third check point. Example. If a player wishes to go as far as he can with less than three men, he may do so, or he may decide to send for reinforcements as soon as he has two men or less. The choice is his. When reinforcements are called for the player returns to the last check point. If he needs to call for reinforcements before reaching the first check point he returns to the L.Z. and waits there. The reinforcements are represented by a secondary respective colored pawn.

SPECIAL BOARD RULES FOR REINFORCEMENTS a. Player takes shorter chopper trail to the L.Z.

b. Once reaching the L.Z. and traveling on foot resumes, the reinforcements do not play attention to any of the board directions or card instructions. They move according to the toss of the dice, with not directions or obstacles to halt their advancement.

c. When the reinforcements reach the check point, where the remaining squad members are waiting, player then turns all five cards face up and resumes play with a full squad.

d. A player may call for reinforcements only one time during the game. If a player looses more than three men a second time during play, he is eliminated from the game.

12. Once a player reaches his third and final check point, he must continue to the POW camp with the use of one dice only!!!

13. A player must enter the POW camp with the exact number of throws on the dice. However, when a player nears the camp site a continuous movement must be upheld regardless of the number of moves the dice call for, Example. If a player needs two spaces to enter into the POW camp and he throws a six on the dice, he then moves forward two spaces counting the camp as one of the moves and then moves back out of the camp onto the trail with the remaining four moves. If he needs one to enter and rolls a four, he moves forward into the camp with one space and back three spaces, and so on until he rolls the exact amount of moves to enter him into the camp. This back and forth action simulates a fierce battle with the enemy. The first player to accomplish this, wins the game.

14. If a player wishes to lay alone, he simply follows all the rules, to the game, except for that he mist reach the POW camp with his original squad. He may not call for reinforcements. He has only one chance for his LRRP team to accomplish their mission.

15. If the choppers reach the L.Z. with more than enough moves on the dice, the player finishes the rest of his spaces on foot. Example. If a chopper only needs three moves to reach the L.Z. and the player rolls nine on the dice, he moves three spaces with the chopper and then he moves the remaining six spaces on the trail, with his squad's pawn.

16. When a player approaches the third and final check point and he rolls more than the distance needed with the two dice, he completes his moves passed the check point and continues with one dice on his next turn. Example, If a player needs one space to reach the third check point, he may still use the two dice and move pass the third check point, regardless of the amount of moves left. He begins using one dice on his next turn. However, if he rolls a double and goes passed the check point, he then must take his second turn with one dice.

SPECIAL BOARD REGULATIONS

1. There are two stacks of cards:
Red cards indicate, "Combat Loss"
Green cards indicate "Territorial Gain"

When a player lands on either of the above spaces on the board, he chooses the card at the top of the deck corresponding to the space he landed on. He then follows the instructions on the card and places the card back at the bottom of the deck.

COMBAT LOSS a. If a player chooses a card and is told to return to his last check point, then he places his pawn automatically at his last check point, or at the L.Z. if he has not as yet reached his first check point.

b. If the instructions on a card indicate a loss of a man by either a KIA or WIA, then the card representing that man must be turned face down.

c. If a card gives the player a choice of either to lose one turn or spin wheel, then the player misses a turn or takes his chances at the wheel and reads the instructions on the wheel marked COMBAT RISK. If he chooses to spin the wheel, the player reads the instructions that the arrow points to and carries them out.

d. If a player chooses the card telling him to go back to the nearest river or stream, the player places his pawn at the last body of water he passed on the board.

TERRITORIAL GAIN a. When a player lands on "TERRITORIAL GAIN" and the card he selects suggests advancement, the player moves his pawn to that destination, unless the man named on the card has been lost in action or evacuated. In this case the player remains where he is. He does not choose another card and play continues to the next player.

b. If a player selects the card saying "ONE VALID COMBAT LOSS", he holds onto the card to avoid a combat loss. He may use this card at anytime in the game of his choice. He is not forced to use it the very first combat loss situation. Once he decides to use it, he replaces the card at the bottom of the territorial gain stack and is exempt from the combat loss.

c. If the player selects the card saying "WOUNDED MAN RECOVERED", and one or more of his men has been lost then he may use the card to replace one of the men that was lost. If he has not as yet lost any men, then the player may hold onto the card and use it later in the game, when the need for it arises. At this time, the player places the card back at the bottom of the territorial gain stack and replaces the lost man by turning the corresponding squad card face up.

d. If the card selected says "LOW ON WATER, ADVANCE TO NEAREST RIVER OR STREAM", then the player moves forward to the next waterway.

2. When a player approaches the river, he must stop at the river's edge, regardless of the number of moves shown on the dice and lose a turn to allow for time to rig a rope to cross. However, if the player on the previous toss of the dice landed on the space saying "RIVER NOT DEEP, ABLE TO CROSS" he does not lose a turn and he may cross the the river counting it as one board space. If the player approaches the river and tosses a double on the dice, he does not lose one turn. He simply relinquishes his second toss of the dice.

3. If a player lands on a board space saying "LOSS ONE TURN", and has tossed a double on the dice, he does not lose his turn, he relinquishes his second toss.

4. When a player lands on a board space telling him to "SPIN WHEEL", he spins the wheel and reads instructions of wheel marked "COMBAT RISK".

a. If the arrow points to "BOOM", the man at risk is lost and is turned face down, whether he be specified or one of choice.

b. If the arrow points to "SAFE", the man at risk is not lost and remains active in the squad..

c. The other instructions of the "COMBAT RISK" wheel are self explanatory.

5. When a player lands on a board space marked "HAZARDS OF WAR", he spins the wheel and reads the instructions on the section of the wheel marked "HAZARDS OF WAR". All these instructions are self explanatory.

6. If a player either lands on a board space or selects a card telling him to lose one turn or spin wheel, he has the choice of the two, however if he decides to chance the wheel, he reads the section of the wheel marked "COMBAT RISK".

7. Reminder: At any time in the game, whenever a board or card instruction states the losing of a specified man and that man has already been lost and is no longer a member of the squad, then the instructions are ignored and play resumes.

8. For one player to play "SOLITAIRE LRRP", he simply follows all the rules to the game, except that he must reach the POW camp with his original squad. He may not call for reinforcements at any time.

INSTRUCTIONS TO BE WRITTEN ON THE COMBAT LOSS AND TERRITORIAL GAIN CARDS

A. COMBAT LOSS

1. Out of water, go back to the nearest river or stream.
2. Rifleman killed in fire fight return to last check point.
3. Squad leader killed by booby trap, return to last check point.
4. Low on water, go back to nearest stream on your trail.
5. Enemy spotted, go back three spaces.
6. Machine gunner K.I.A. (killed in action) return to last check point.
7. Call for air strike, go back three spaces for safety.
8. Man severely wounded, call for Medi-Vac. Return to last check point, lose one man.
9. Medic killed by sniper, return to last check point.
10. Man stepped on land mine, lose turn or spin wheel.
11. M-79 man killed by ambush, return to last check point.
12. Enemy captured go back to last check point.
13. Man triggered booby trap, lose turn or spin wheel.
14. Your squad is lost, return to last check point.
15. Man wounded by sniper, lose one turn for medical treatment.
16. Out of supplies, go back to last check point.
17. One of your men has been overtaken by poison gas, lose one man.
18. Send out one man for scouting lose one turn or spin wheel.
19. Large V.C. force, go back six spaces to avoid contact.
20. Enemy encounter, lose one man.

B. TERRITORIAL GAIN

1. Machine gunner destroyed enemy bunker, advance three spaces.
2. Wounded man recovered. If you lost any men, replace one, if no men were lost, hold card.
3. Discovered shortcut to next check point, go ahead five spaces.
4. Able to cross river instead of trail, advance three spaces.
5. Trail ahead is clear, advance three spaces.
6. Discovered V.C. trail, advance four spaces.
7. Medic saved squad leader's life, advance three spaces.
8. Advance six spaces.
9. Aid from mountaingnard villagers, advance four spaces.
10. Grenade launcher (m-79 man) killed sniper in tree, advance two spaces.
11. One valid combat loss, keep this ticket to avoid combat loss.
12. Low on water, advance to nearest river or stream on trail.
13. Discovered V.C. trail, advance four spaces.
14. Squad leader discovered enemy camp, advance three spaces.
15. M-16 man killed enemy, advance two spaces.
16. Advance three spaces.
17. Enemy aircraft approaching, go ahead three spaces for cover.
18. Advance three spaces.
19. Destroyed enemy machine gun nest take one turn.
20. Captured enemy officer advance to next check point.

INSTRUCTION OF THE SPINNER WHEEL

I. HAZARDS OF WAR:

1. Man bitten by poisonous snake. Go back to last check point. LOSE ONE MAN.
2. Dense jungle. LOSE ONE TURN.
3. Man stricken with Malaria. Go back to last check point. LOSE ONE MAN.
4. You risked taking a muddy V.C. trail for a short cut and you were successful. TAKE ANOTHER TURN.
5. You are out of supplies. GO BACK TO LAST CHECK POINT.
6. Send out a scout for reconnaissance. LOSE ONE TURN.
7. Heavy rains are causing slow movement. LOSE ONE TURN.
8. One of your men has been overtaken by heat exhaustion, stop to rest. LOSE ONE TURN.

II. COMBAT RISK

1. "SAFE"
2. "BOOM". LOSE ONE MAN!
3. Slight injury. CONTINUE ON!
4. "SAFE"
5. Wounded, but not serious. CONTINUE ON!
6. "BOOM". LOSE ONE MAN!
7. Slight injury. LOSE ONE TURN!
8. Serious injury. LOSE ONE MAN!

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A long range reconnaissance patrol Vietnam War board game comprising:
   (a) a game board with jungle background having a plurality of different colored trails, one for a chopper ride and other trails to be used by squads on foot, said game board also having a POW camp, chopper pad, L.Z., river and streams, V. C. trails, V. C. village, mountaingnard village, rice paddy, combat loss space and territorial gain space disposed onto the background of said game board;
   (b) a plurality of helicopter playing pieces each colored to match one of said colored foot trails;
   (c) a plurality of squad team sets of squad member character cards, each said squad team set colored to match one of said helicopter playing pieces;
   (d) a plurality of first type pawns to represent squad movement on said game board, each said pawn colored to match one of said squad teams of squad member character cards;
   (e) a plurality of combat loss cards;
   (f) a plurality of territorial gain cards;
   (g) a spinner wheel having a double headed random pointer to point at a combination of hazards of war and combat risk information to be used during play of said board game;

(h) a plurality of second type pawns to represent reinforcements, each said pawn colored to match one of said squad teams of squad member character cards; and (i) a pair of playing dice.

2. A long range reconnaissance patrol Vietnam war board game as recited in claim 1, wherein each squad member character card of each said squad team includes:

(a) a squad leader card being head man and decision maker of said squad team;

(b) a medic card being a man with medical knowledge of first aid treatment;

(c) a rifleman card being a man using an M-16 automatic semi-automatic weapon;

(d) an M-79 man card being man carrying a weapon used to launch grenade type projectiles and also carries the squad radio; and (e) a machine gunner card being a man carrying an M-60 automatic machine gun.

3. A long range reconnaissance patrol war board game as recited in claim 2, wherein each said trail on said game board includes a plurality of playing segments having indicia on some of said playing segments to indicate playing instructions during play of said board game.

4. A long range reconnaissance patrol Vietnam war board game as recited in claim 3, wherein said spinner wheel further includes a second single headed pointer and a plurality of numbers disposed thereabout so that said two pointers can be used together to randomly choose numbers to move said helicopter playing pieces, said first type pawns and said second type pawns along said playing segments of said trails in place of said playing dice.

* * * * *